United States Patent [19]

Auth et al.

[11] 4,442,817

[45] Apr. 17, 1984

[54] ELECTRONICALLY CONTROLLED FUEL METERING SYSTEM

[75] Inventors: Werner Auth, Stuttgart; Gunter Felger, Leonberg, both of Fed. Rep. of Germany

[73] Assignee: Robert Bosch GmbH, Stuttgart, Fed. Rep. of Germany

[21] Appl. No.: 386,376

[22] Filed: Jun. 8, 1982

[30] Foreign Application Priority Data

Jun. 24, 1981 [DE] Fed. Rep. of Germany ..... 3124676

[51] Int. Cl.[3] ..... F02M 7/00

[52] U.S. Cl. ..... 123/489; 123/440

[58] Field of Search ..... 123/489, 440, 472, 480

[56] References Cited

U.S. PATENT DOCUMENTS

| | | | |
|---|---|---|---|
| 4,140,086 | 2/1979 | Schnurhe et al. | 123/489 |
| 4,208,993 | 6/1980 | Peter | 123/489 |
| 4,210,106 | 7/1980 | Wessel et al. | 123/489 |
| 4,357,922 | 11/1982 | Rosenzopf et al. | 123/489 |
| 4,380,986 | 4/1983 | Hatsch et al. | 123/489 |
| 4,383,515 | 5/1983 | Higashiyama et al. | 123/489 |

*Primary Examiner*—Raymond A. Nelli

*Attorney, Agent, or Firm*—Edwin E. Greigg

[57] ABSTRACT

An electronically controlled fuel metering system for an internal combustion engine is proposed which has mixture regulation which can be switched on and off depending upon the operational state of the engine. The system for mixture regulation includes an integrator with an alternating integration direction which can be switched on during steady and quasi-steady operational states. It is further proposed that the integrator time constant be selected in accordance with operating characteristics of the engine and time during the regulation period. For mixture metering, average values are used based on switching values, for instance of a λ sensor in the exhaust pipe. The proposed system is also useable in connection with learning regulating systems, in which corrected values for $\lambda=1$ or values for $\lambda\neq1$ computed on that basis and these values then serve as initial values for new regulating cycles.

20 Claims, 3 Drawing Figures

ELECTRONICALLY CONTROLLED FUEL METERING SYSTEM

BACKGROUND OF THE INVENTION

The invention relates to an electronically controlled fuel metering system for an internal combustion engine. The electronically controlled fuel metering system provides for mixture regulation which can be switched on and off as a function of the operational state of the engine. The system includes an integrator with a reversible integration direction.

A system of this kind having mixture regulation which can be switched on and off and which includes an integrator is already known. In the known system, the mixture regulating device is switched over to controlled operation during, for example, overrunning, and the integrator is simultaneously fixed at a predetermined output value. It has been demonstrated that the known system is not capable of providing satisfactory results for all operational states of the engine, particularly with respect to clean exhaust and low fuel consumption.

OBJECT AND SUMMARY OF THE INVENTION

It is an object of the present invention to provide mixture regulation for an internal combustion engine which can be switched on and off as a function of the particular operational state of the engine.

According to the present invention mixture regulation is provided for an internal combustion engine including an integrator having a reversible integration direction which can be switched during steady and quasi-steady operational states of the engine.

The fuel metering system according to the present invention assures continuous optimal operation of the internal combustion engine. In addition, a lean-rich change in the fuel-air mixture during steady operational states of the engine, which basically is preconditioned for λ regulation, can be avoided, at least beyond a predetermined duration of steady operation. Thus poor exhaust emission values, which might otherwise occur periodically, are not produced.

The invention will be better understood and further objects and advantages thereof will become more apparent from the ensuing detailed description of preferred embodiments taken in conjunction with the drawings.

DESCRIPTION OF THE EXEMPLARY EMBODIMENTS

The present invention will now be described in connection with a fuel injection system having λ control including a sensor in the exhaust system of the internal combustion engine. It must be emphasized that the present invention is not dependent upon the type of fuel metering and in principle is also not dependent on the detection of a signal for the fuel-air mixture. In other words, the sensor for detecting the fuel-air mixture is not restricted to the evaluation of an exhaust gas signal (λ signal), but may instead be placed on the intake side of the internal combustion engine as well.

Figure 1:
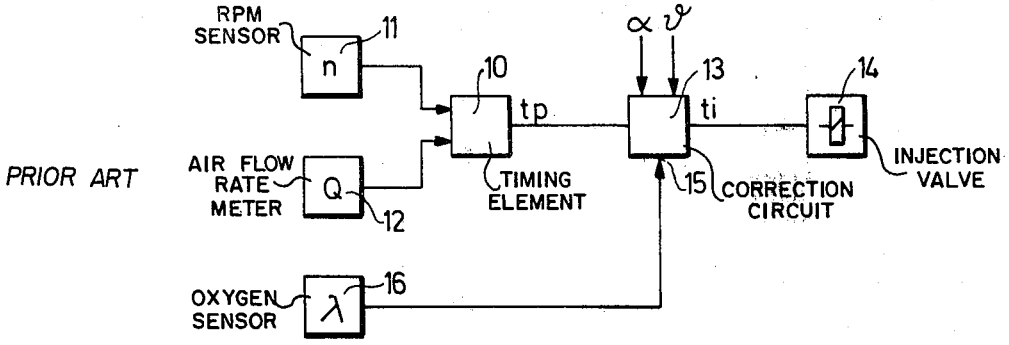
FIG. 1 is a block diagram illustrating the basic elements of an electronically controlled fuel metering system for an internal combustion engine having mixture regulation known in the prior art.

In FIG. 1, reference numeral 10 refers to a timing element which is on its input side receives signals from an rpm sensor 11 and an air flow rate meter 12, and on its output side emits an uncorrected injection signal having the duration (tp). This signal is corrected in a subsequent correction circuit 13 in accordance with such engine operating characteristics as temperature ($\theta$) or acceleration ($\alpha$) processes, and finally this corrected injection signal determines the opening duration of an injection valve 14, now shown in further detail. In order to realize the noted mixture regulation, the correction circuit 13 has a further input 15 for the signal from a λ sensor 16.

The subject of FIG. 1 has long been known in the prior art (see, for example, U.S. Pat. No. 4,275,695). More recently, the signal-processing blocks 10 and 13 have increasingly been replaced with computer control means, which, in principle, are equally well known.

Figure 2:
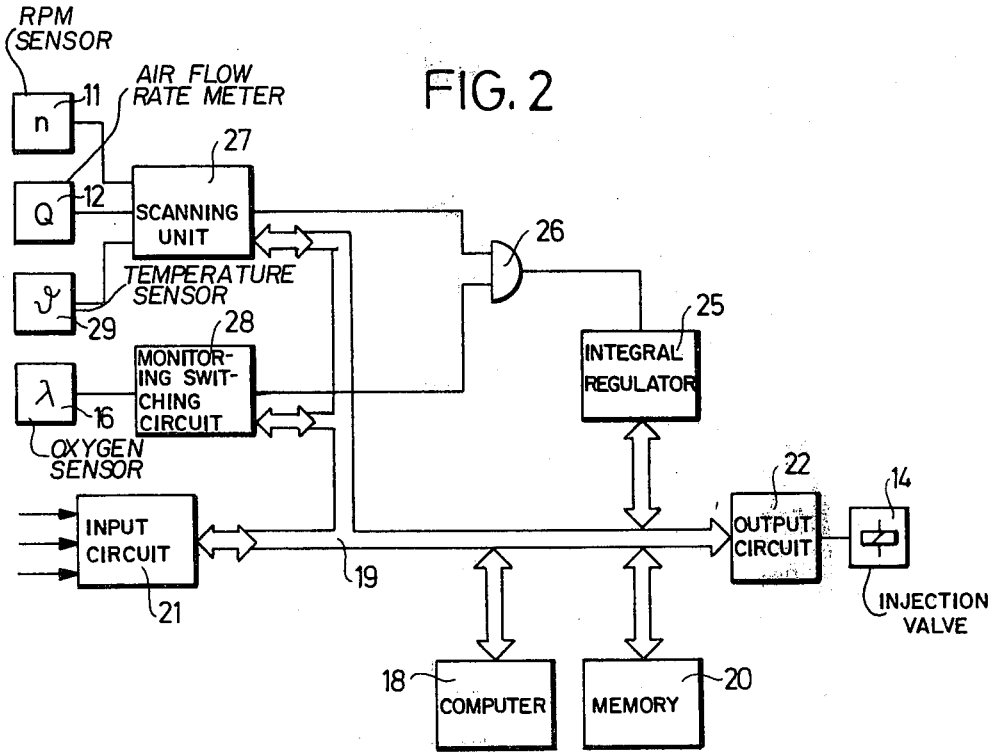
FIG. 2 is a detailed block diagram of a computer-controlled control system for fuel metering in accordance with the present invention.

FIG. 2 illustrates details of a computer-controlled system together with the improvement in accordance with the present invention, which is shown here symbolically in the form of a block diagram with hardware components for the sake of better explanation. In general, these blocks, with the exception of the sensors and the injection valve, comprise the computer system. Reference numeral 18 refers to the computer itself, (e.g. Intel 8059) which is connected via a data bus 19 with at least one memory unit 20. Input data from an input circuit 21 also reaches the means of signal processing via the data bus 19 and the computed values accordingly proceed to an output circuit 22, which preceeds the electromagnetic injection valve 14.

An integral regulator 25 is provided. It is also connected with the data bus 19 and furthermore receives control signals via an AND gate 26 from a Δ scanner unit 27 and a monitoring switching circuit 28 for the output from the λ sensor 16. * The Δ scanning unit 27 responds to changes in the output signals of the rpm sensor 11, the air flow rate sensor 12 and the temperature sensor 29, and thus permits the determination of steady and unsteady states of the internal combustion engine. At the beginning of a steady or quasi-steady state, the values of the input variables are stored in the Δ scanner unit 27 and are continuously compared with the instantaneous values at a particular time. As soon as the deviation Δ for one of these input variables exceeds a predetermined value, there is a switchover in unit 27 such that the particular values of the input variables existing at that time are entered in the appropriate memory. The signal for an unsteady state then appears at the output of the Δ scanning unit 27, as a result of which mixture regulation is shut off and a switchover to controlled operation is made. Independently of this, however, the input variables continue to be scanned as to whether they continue to exist. If the deviations decrease, then the signal for quasi-steady operation again appears at the output of the Δ scanning unit 27, as a result of which the mixture regulation system is activated once again.

* (Prior out U.S. Pat. Nos. 4,208,993, 4,140,086) The integral regulator 25 delivers a correction-signal, which is added to a signal formed by the computer and which is dependent on other input signals. The summing-signal is fed to the output circuit 22.

By way of example, the Δ scanning unit 27 as shown in FIG. 2 receives three input values. Naturally there is no restriction as to inputs, and the input variables can be generally designated by the symbol Ei (tn).

Figure 3:
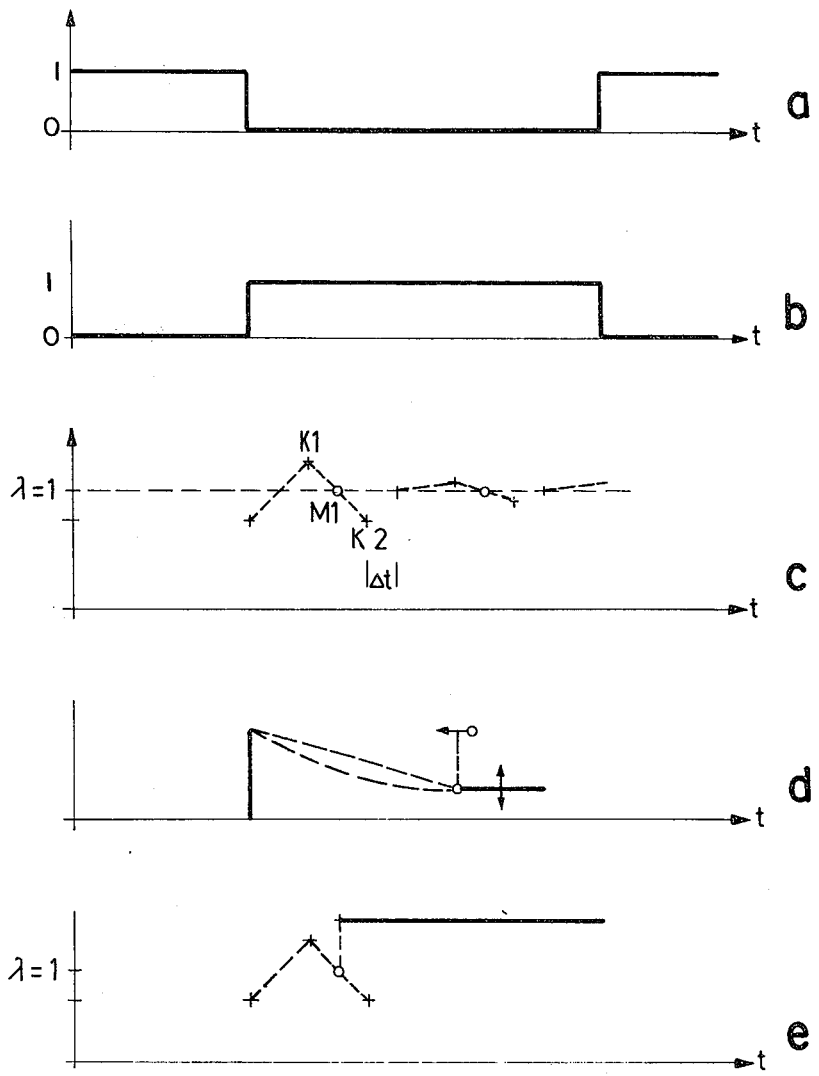
FIG. 3 shows various diagrams explaining the mixture regulating device according to the present invention.

FIG. 3 provides various diagrams for explaining the present invention. The time diagram of FIG. 3*a* indicates when the Δ scanning unit 27 of FIG. 2 emits corresponding signals depending upon the operational state of the engine. A zero signal represents a steady or quasi-steady operation and a 1 signal represents the existence of an unsteady or transitional state.

Since the mixture regulation is intended to function only during steady operational states of the engine, the λ regulating device in the arrangements of FIGS. 1 and 2 is switched on in accordance with FIG. 3*b*.

FIGS. 3*c–e* show details relating to the mode of operation for mixture regulation.

When the Δ scanning unit 27 and the monitoring switching circuit 28 activate the mixture regulation in accordance with FIG. 3*b*, then the integral regulator 25 moves away from a null correction valve to one which is, for instance, in the direction of a rich fuel-air mixture. The slope of the integration is proportional to the air throughput in the engine intake tube (not shown) and is selected to be such that the most rapid possible approach to a value of $\lambda=1$ is attained, without, for example, oscillation problems occurring in the regulating circuit. The correction values K1 and K2 at the switchover points of the integral regulator 25 are stored in memory.

The next step is forming an average value of associated maximum (K1) and minimum (K2) values utilizing the computer 18 and memory 20. Forming the average value is effected on the basis of two or even more values occurring in sequence. The mixture regulation then functions with the average value M, and only after a certain dead time (Δt) is the integral regulation permitted to run up again from this average value. Following this, the computer again forms the average value between at least two switchover points, and the mixture metering orients itself to the new average value for at least a predetermined new dead time (Δt). What is important is that the individual correction cycles run their course with a variable integrator slope, which in the present case becomes less steep.

While in the diagram of FIG. 3*c*, the same integrator slopes are used for a predetermined measurement cycle, FIG. 3*d* illustrates a variant such that the initial slope of the integrator is in fact selected in accordance with the air throughput, but thereafter the slope is reduced either linearly, incrementally, or in accordance with an arbitrary function. It has proved to be effacacious to limit the duration of this reduction by the integrator time constant, and in particular to keep it variable. It is also recommended to select the final value of the integrator slope in accordance with operating characteristics.

If the least integrator slope has been attained without the regulation having been shut off by the Δ scanning unit 27, then the regulation functions with this least integrator slope until an unsteady operational state appears. The advantages of this mode of operation with different integrator slopes are clearly seen from FIG. 3*c*. The deviations in the mixture composition from a constant value are reduced during the regulating process and thus no undesirable periodic peaks in exhaust emissions occur.

The regulation described in connection with FIG. 3*c* at first produces mixture ratios such that $\lambda=1$. If mixture ratios resulting in λ values unequal to 1 are desired, then with the above method a basic value is first ascertained, which corresponds to the corrected fuel injection quantity for $\lambda=1$, and this value is multiplied by the derived λ value for a specialized operational point. In this manner, an arbitrary λ value can be associated with each (steady) operational state of the engine. This is illustrated in FIG. 3*e*. This diagram shows that an average value M, once formed, is varied in its level; this varied value becomes effective for a predetermined period of time; finally, the new regulating cycle begins based on this varied value.

As a rule, the individual control values are read out of memories in the case of fuel metering systems which operate digitally. The individual stored values are empirically ascertained. Furthermore, so-called learning regulating systems are known in principle, where values once stored continuously replaced by new and corrected values. The present invention has also proved to be particularly well suited for such learning regulating systems, because in this case optimal values are ascertained for every steady and quasi-steady operational state, and these values, once stored, can become the point of departure for new regulation. Among other features, the invention described above relates to the integration content of the integral regulator for the mixture regulating device, this constant differing with time. In digital systems, an integrator of this kind can be realized by means of, for example, an up-down counter.

For one skilled in the data processing field, producing a corresponding regulating program presents no problem once the pulse diagrams of FIG. 3 are known. Disclosures exist for such programs; for instance, a "data processing system" is disclosed in great detail in U.S. Pat. No. 3,077,984, with which system—naturally with appropriate programming—any desired function at all can be realized digitally, and in particular the function according to the principles of this invention. The same applies to realizing the invention by means of structural components, because integral regulators with definite integrator time constants, for instance dependent on the air throughput in the intake of an internal combustion engine, are sufficiently well known.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An electronically controlled fuel metering device for an internal combustion engine having a mixture regulation system comprising an integrator with a reversible integration direction for controlling said mixture regulation system switching means connected to said integrator during steady and quasi-steady operational states of the engine, a λ detection means connected to said switching means, and said integrator having a time constant which is time-dependent after each occurrence of at least one switchover point of the integration slope thereof in response to said switching means.

2. A method for electronically controlling fuel metering in an internal combustion engine having a mixture regulating system controlled by an integral regulator, comprising the steps of detecting λ values for said integral regulator activating said integral regulator during steady and quasi-steady operational states of said engine, and varying the time constant of said integral regulator in accordance with time after each occurrence of at least one switchover point of the integration slope thereof in response to said λ detection.

3. The electronically controlled fuel metering system, as defined in claim 2, wherein the time dependency of the time constant exists only during a predetermined total time duration.

4. The electronically controlled fuel metering system as defined in claim 2, wherein the time constant of the integrator is variable in accordance with the regulating cycle.

5. The electronically controlled fuel metering system, as defined in claim 4, wherein the regulating cycle has a predetermined number of cycles.

6. The electronically controlled fuel metering system, as defined in claim 2, wherein the time constant of the integrator is dependent on time and also on the air throughout in the intake tube of the engine.

7. The electronically controlled fuel metering system, as defined in claim 6, wherein the time dependency of the time constant exists only during a predetermined total time duration.

8. The electronically controlled fuel metering system, as defined in claim 2, wherein the time constant of the integrator is reduced during steady operational states of the engine and again increased during unsteady operational states of the engine, preferably in accordance with operating characteristics of the engine.

9. The electronically controlled fuel metering system, as defined in claim 2, wherein the time constant of the integrator is steadily variable.

10. The electronically controlled fuel metering system, as defined in claim 2, wherein the time constant of the integrator is unsteadily variable.

11. The electronically controlled fuel metering system, as defined in claim 2, wherein the time constant of the integrator is steadily and unsteadily variable.

12. The electronically controlled fuel metering system, as defined in claim 2, wherein the output of the integrator is arithmatically averaged for two or more switchover points in response to said switching means, for mixture regulations.

13. The electronically controlled fuel metering system, as defined in claim 12, wherein subsequent mixture regulation is based on said arithmatic average value.

14. The electronically controlled fuel metering system as defined in claim 12, wherein a dead time is imposed between sequential regulating cycles and the formation of said arithmatic average values.

15. The electronically controlled fuel metering system as defined in claim 12, wherein the arithmatic average values are computed for arbitrary λ values on the basis of the values ascertained for $\lambda=1$.

16. The electronically controlled fuel metering system as defined in claim 15, wherein the individual λ values are variable additively.

17. The electronically controlled fuel metering system as defined in claim 15, wherein the individual λ values are variable multiplicatively.

18. The electronically controlled fuel metering system as defined in claim 15, wherein the individual λ values are variable additively and multiplicatively.

19. The electronically controlled fuel metering system as defined in claim 12, wherein the output of the integrator is stored, corrected by the arithmatically averaged values and the corrected values stored.

20. The electronically controlled fuel metering system as defined in claim 19, wherein the stored corrected values are further addressable.

* * * * *